United States Patent [19]

Starck

[11] 4,373,295

[45] Feb. 15, 1983

[54] RESILIENT FRICTION SASH BALANCE

[75] Inventor: William R. Starck, Greenwich, Conn.

[73] Assignee: A.M.S. Corporation, South Norwalk, Conn.

[21] Appl. No.: 211,327

[22] Filed: Nov. 12, 1980

[51] Int. Cl.[3] ..... E05D 15/16

[52] U.S. Cl. ..... 49/435; 49/432

[58] Field of Search ..... 49/428, 423, 434, 435, 49/432, 443, 505

[56] References Cited

U.S. PATENT DOCUMENTS

| | | | |
|---|---|---|---|
| 1,715,909 | 6/1929 | Ehrsam | 49/434 X |
| 2,267,021 | 12/1941 | Glass | 49/435 |
| 3,269,062 | 8/1966 | Mears, Jr. | 49/505 |
| 4,034,510 | 7/1977 | Huelsekopf | 49/432 X |

*Primary Examiner*—Kenneth Downey

*Attorney, Agent, or Firm*—Mattern, Ware, Stoltz & Fressola

[57] ABSTRACT

A unitary weatherstripping and self-balancing sash guide for slidingly embracing the juxtaposed side edges of a pair of double-hung inner and outer window sash units, and guiding their sliding opening and closing movement in a window opening, comprises an arched portion spanning the side edge of the window opening and having a central parting bead protruding into the window opening, inner and outer terminal flanges protruding from the arched portion into the window opening, and two slanting wing flanges respectively extending cantilever-fashion from the parting bead diagonally toward the arched portion and the respective terminal flanges, forming therewith a pair of channel-shaped grooves each embracing the side edge of one sash unit, whereby each of the two sash units is slidingly gripped in resilient tractive balancing engagement between a terminal flange and a facing slanting wing flange resiliently deformed by the embraced sash unit.

2 Claims, 4 Drawing Figures

RESILIENT FRICTION SASH BALANCE

TECHNICAL FIELD

This invention relates to window sash guides for double-hung windows and particularly to a unitary resilient self-balancing sash guide capable of maintaining the window sash in any desired raised position from the top to the bottom of the window frame without requiring counterweight sash balances, tension spring sash balances, torsion spring sash balances or other costly separate attachments to maintain the sash in its raised position. These unitary resilient deflectable self-balancing sash guides are preferably formed as extrusions of plastic material having a central substantially rectangular hollow parting bead provided with diagonally protruding wing flanges extending from an inner portion of the parting bead toward the outer side edge of the window sash and bearing against the face of the window sash in sliding engagement, with the sash resiliently deflecting and deforming its wing flange, producing tractive friction force applied against the face of each sash tending to maintain it in any raised or lowered position.

BACKGROUND ART

Various United States patents have proposed sash guides incorporating diagonal flexible flanges employed to produce resilient force bearing against window sashes when deflected by installation of the sash. Sylvan U.S. Pat. No. 2,244,739 shows rolled sheet metal sash guides provided with a long diagonal tongue 16 extending from the outside corner of the sash guide inwardly toward the edge surface of the window sash. Sylvan's tongue is employed for balancing the sash and also for providing a weatherstripping action. In addition, the inner and outer terminal flanges of Sylvan's rolled metal section sash guide are resilient and thus hold the sash guide in place in the jamb in which the weatherstrip is located, but the resilience of these inner and outer flanges of Sylvan's sash guide does not apply any resilient force against the sash.

Resilient "Z" cross-section or "U" cross-section rolled sheet metal sash guide supports are shown in Gardner, Jr., U.S. Pat. No. 2,613,403, and resilient "Z" cross-section leaf spring weatherstripping material is shown in Dennis, U.S. Pat. No. 1,666,327; Blessin, U.S. Pat. No. 1,976,767; and Beil, U.S. Pat. No. 2,541,325. Resilient leaf spring sash guides employed for weatherstripping are shown in Robinson, U.S. Pat. No. 2,192,776; Mears, Jr., U.S. Pat. No. 3,269,062 and Hettinger, U.S. Pat. No. 2,775,795. All these patents apply resilient force along the edge surfaces of the sliding sash unit, rather than against the face of the sash. For this reason the prior art resilient weatherstripping sash balances permit lateral rocking play of the sash sidewise between two opposing resilient leaf spring flanges, and precise alignment and positioning of the sash is not possible with these prior art proposals.

With the present invention, direct diagonal resilient flanges apply pressure against a face of each sash along its vertical edge, urging the sash outwardly toward the outer fixed flange of the unitary sash guide and thus assuring its precise positioning without rocking or lateral play, while still achieving the advantages of resilient balancing and weatherstripping.

DISCLOSURE OF THE INVENTION

The unitary sash guides of the present invention offer these weatherstripping and resilient leaf spring balancing features combined with significant manufacturing economy, since the preferred embodiments of the invention are formed as unitary plastic extruded sections. A gently arched configuration accommodates the slightly tapered side edge surfaces of the sash. This arched cross-section joins the inner terminal flange to the outer terminal flange of the sash guide, and the center portion of the arch supports a rigidifying box beam or channel-shaped parting bead section, which forms a hollow rectangular central part of the extrusion. Extending from the innermost corners of this parting bead section of the extrusion are diagonally extending wing flanges slanting outward toward the arched wall of the sash guide, producing a resilient depressible balancing flange which also provides weatherstripping action. Insertion of the sash between the wing flange and the opposing terminal flange depresses the wing flange thereby urging the sash against the outer terminal flange and providing sash balancing tractive force between the sash and its sash guide.

Accordingly, a principal object of the present invention is to provide a lightweight, easily fabricated and highly economical window sash guide for double-hung sliding sash windows incorporating a central parting bead having diagonally extending wing flanges resiliently deflectable by installation of sliding window sash to apply tractive sash balancing and weatherstripping force directly against the face of the sash.

Another object of the invention is to provide unitary extruded sash balances of this character providing resilient tractive sash balancing without requiring any additional component parts whatever.

Other objects of the invention will in part be obvious and will in part appear hereinafter.

The invention accordingly comprises the features of construction, combinations of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings in which:

BEST MODE FOR CARRYING OUT THE INVENTION

Figure 1:
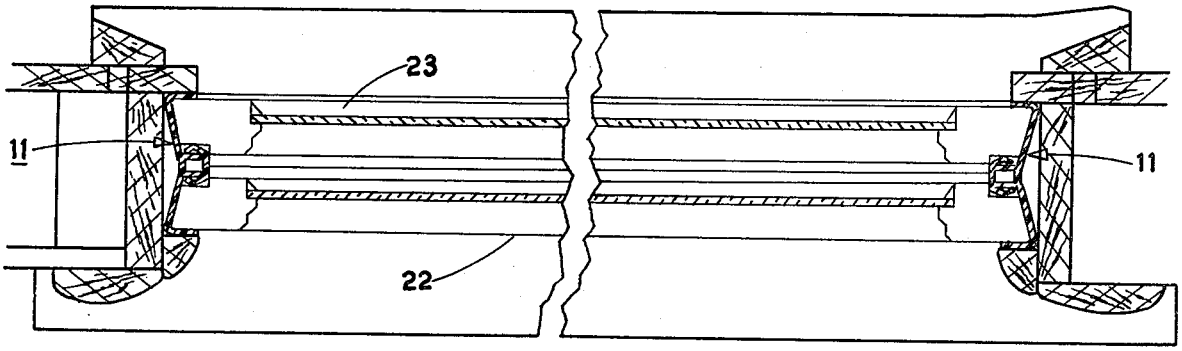
FIG. 1 is a top plan cross-sectional view, partially broken, of a double-hung sash window with both sliding window sashes embraced between unitary extruded sash guides of the present invention.
Figure 2:
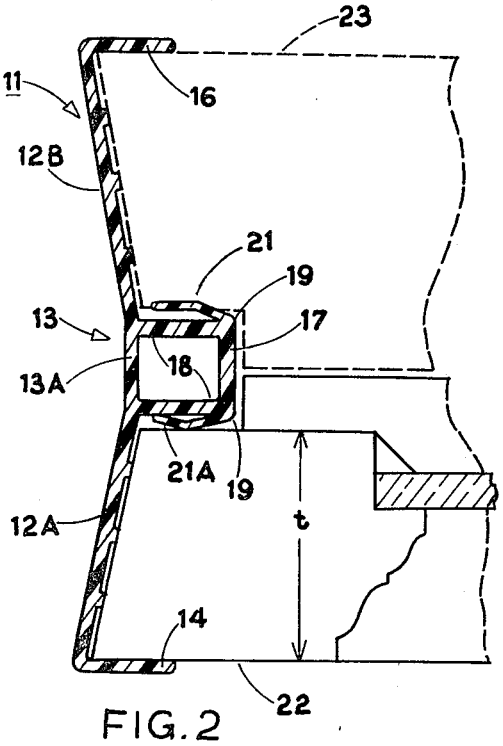
FIG. 2 is a similar enlarged cross-sectional plan view of the adjacent side edges of both double-hung window sashes and the single unitary extruded sash guide with which they are engaged.
Figure 4:
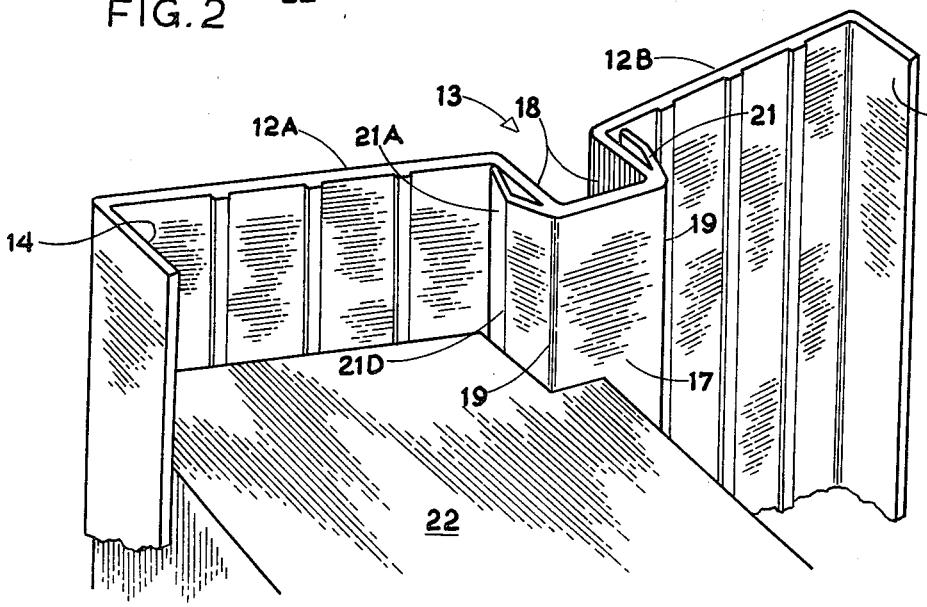
FIG. 4 is a fragmentary cross-sectional perspective view showing a portion of the unitary extruded sash guide of the present invention with a window sash installed.

As shown in FIGS. 1, 2 and 4, the unitary sash guides of the present invention are typified by a plastic extrusion having an arched cross-section. The sash guide 10 of the present invention thus comprises an arched central portion 11 comprising a pair of oppositely slanting raked sash-facing panels 12, unitarily joined by a substantially flat central parting bead portion 13, and whose outer edges are inturned to form terminal flanges, an inner terminal flange 14 protruding from the inner edge of the inner sash-facing panel 12A, and an outer terminal flange 16 protruding from the outer edge of the outer sash-facing panel 12B. Protruding inward toward the two sliding double-hung window sashes at the central parting bead portion 13 is an extruded box beam or channel-shaped section forming a parting bead, preferably substantially rectangular in cross-section and defined by an inner bead panel 17 and two bead sidewalls 18 forming a substantially rectangular box configuration as illustrated in the figures. The inner bead panel 17 facing the interior of the window opening is contiguously joined at the corners 19 of the substantially rectangular box cross-section to the inner edges of both bead side walls 18. The outer edges of bead side walls 18 may be joined by a bridge panel 13A, if desired, as shown in FIG. 2.

SLANTING WING FLANGES

Protruding from the inner corners 19 of the parting bead diagonally outward toward the sash facing panels 12A and 12B are respective slanted wing flanges diverging diagonally from the bead side walls 18. The wing flanges 21 may be formed as flat panels, arched panels, or bent panels in the form illustrated in the figures.

Figure 3:
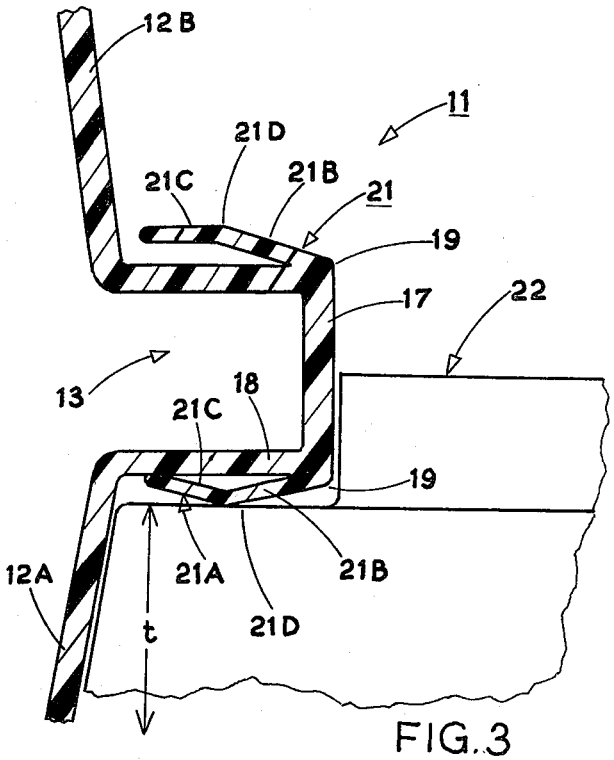
FIG. 3 is a similar further enlarged fragmentary cross-sectional plan view of the central portion of a slightly modified unitary extruded sash guide of the present invention showing its normal undeflected diagonal wing flange and a second diagonal wing flange resiliently deformed by an installed window sash applying tractive force thereto.

As shown in FIGS. 3 and 4, the relaxed, undeformed position of wing flanges 21, predetermined by the extruding die, are characterized by the small but ample spacing between the diagonal wing flanges 21 and side walls 18 of the parting bead, before window sash 22 is installed between wing flange 21 and inner terminal flange 14. As illustrated in the figures, the thickness "t" of sash 22 fitting between these two flanges causes the diagonal wing flange 21 to be resiliently deformed (as at 21A in FIG. 3) and urged away from the remote terminal flange 14 and toward the adjacent bead side wall 18. As shown in FIGS. 2, 3 and 4, the thickness "t" of sash 22, relative to the width of sash-facing panel 12A, will normally be sufficient to depress the distal edge of wing flange 21 to position 21A, against bead side wall 18, limiting the resilient flexing deformation of flange 21 and minimizing its further bending deformation.

SASH BALANCING FORCE

As indicated in the figures, the force applied by resiliently deflected wing flange 21 against sash 22 urges sash 22 against the opposing terminal flange 14, providing counteracting forces tending to grip or "squeeze" both faces of sash 22—the interior face of sash 22 facing the inside of the building in sliding engagement with terminal flange 14, and the exterior face of sash 22 in sliding engagement with the resiliently deflected wing flange 21. These counteracting tractive forces provide weatherstripping sealing along the side edge of the sash, and also provide sash balancing force through the frictional engagement of the sash 22 with flange 14 and wing flange 21, with the static frictional force balancing the weight of the sash in the same manner that counterbalanced sash weights or spring sash balances are used to balance the weight of the sash itself.

The preferred flat "bent" shape of wing flanges 21 illustrated in the figures comprises a proximal diagonal panel segment 21B protruding directly from corner 19 of the parting head, and a contiguous distal portion 21C which in its extruded, relaxed condition is substantially parallel to bead sidewall 18. Installation of sash 22, deflecting wing flange 21 to position 21A, concentrates the tractive force between the sash and the flange along the central outer face 21D. This assures that the bending moment arm of the deflecting force applied to the proximal wing flange panel 21B remains constant, even if long continued use and ageing of the extruded plastic body of sash guide 10 should result in some reduction of its internal elastic resilience applying the reactive tractive force to sash 22.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A unitary sash guide for slidingly embracing the juxtaposed side edges of a pair of double-hung inner and outer window sash units, and guiding their sliding opening and closing movement in a window opening, comprising an arched portion spanning the side edge of the window opening and having a central channel-shaped parting bead protruding convexly into the window opening, an inner terminal flange protruding from the inner part of the arched portion into the window opening, an outer terminal flange protruding from the outer part of the arched portion into the window opening, a slanting inner wing flange extending cantilever-fashion diagonally from an inner corner of the channel-shaped parting bead toward the arched portion and the inner terminal flange, forming therewith a channel-shaped groove embracing the side edge of the inner sash unit, and a slanting outer wing flange extending cantilever-fashion diagonally from an outer corner of the channel-shaped parting bead toward the arched portion and the outer terminal flange, forming therewith a channel-shaped groove embracing the side edge of the outer sash unit, with each wing flange incorporating a substantially flat distal edge panel, and with the entire sash guide being a unitary extrusion formed of plastic material, whereby each of the two sash units is slidingly gripped in resilient tractive balancing engagement between a terminal flange and a facing slanting wing flange resiliently deformed by the embraced sash unit.

2. The unitary sash guide defined in claim 1 wherein the channel-shaped parting bead is bridged by an integral panel enclosing the channel to form a rectangular box beam section parting bead portion of the extrusion, and wherein each slanting wing flange projects diagonally from an inner corner of the box beam parting portion of the unitary extrusion.

* * * * *

UNITED STATES PATENT AND TRADEMARK OFFICE

CERTIFICATE OF CORRECTION

PATENT NO. : 4,373,295

DATED : February 15, 1983

INVENTOR(S) : William R. Starck

It is certified that error appears in the above-identified patent and that said Letters Patent are hereby corrected as shown below:

Column 6, line 3 - insert --bead-- before "portion"

Signed and Sealed this

*Seventh* Day of *June 1983*

[SEAL]

*Attest:*

DONALD J. QUIGG

*Attesting Officer*

*Acting Commissioner of Patents and Trademarks*